US009496645B2

(12) United States Patent
Reed

(10) Patent No.: US 9,496,645 B2
(45) Date of Patent: Nov. 15, 2016

(54) LOW PROFILE LATCHING CONNECTOR

(71) Applicant: MOLEX INCORPORATED, Lisle, IL (US)

(72) Inventor: Bruce Reed, Maumelle, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/899,895

(22) PCT Filed: Jul. 9, 2014

(86) PCT No.: PCT/US2014/045865
§ 371 (c)(1),
(2) Date: Dec. 18, 2015

(87) PCT Pub. No.: WO2015/006396
PCT Pub. Date: Jan. 15, 2015

(65) Prior Publication Data

US 2016/0149341 A1 May 26, 2016

Related U.S. Application Data

(60) Provisional application No. 61/844,757, filed on Jul. 10, 2013.

(51) Int. Cl.

| | |
|---|---|
| ***H01R 4/50*** | (2006.01) |
| ***H01R 13/629*** | (2006.01) |
| ***H01R 13/627*** | (2006.01) |
| ***H01R 13/633*** | (2006.01) |

(52) U.S. Cl.
CPC ..... *H01R 13/629* (2013.01); *H01R 13/6272* (2013.01); *H01R 13/6275* (2013.01); *H01R 13/6335* (2013.01)

(58) Field of Classification Search
CPC ..... H01R 13/6275; H01R 13/6272
USPC ..... 439/345, 352, 358, 350, 357, 370, 488
See application file for complete search history.

(56) References Cited

U.S. PATENT DOCUMENTS

| | | | | |
|---|---|---|---|---|
| 7,281,937 | B2 | 10/2007 | Reed et al. | |
| 7,354,292 | B1 * | 4/2008 | Lloyd | H01R 13/6272 439/352 |
| 9,028,270 | B1 * | 5/2015 | Vanderwoud | H01R 13/6335 439/476.1 |
| 2009/0042431 | A1 | 2/2009 | Herring et al. | |
| 2012/0040552 | A1 * | 2/2012 | Wu | H01R 13/6581 439/358 |
| 2012/0171879 | A1 | 7/2012 | Wang et al. | |
| 2012/0282790 | A1 | 11/2012 | Wang et al. | |
| 2013/0005173 | A1 | 1/2013 | Reed et al. | |
| 2015/0111417 | A1 * | 4/2015 | Vanderwoud | H01R 13/6335 439/476.1 |

FOREIGN PATENT DOCUMENTS

| | | |
|---|---|---|
| JP | 2010-211943 A | 9/2010 |

* cited by examiner

*Primary Examiner* — Phuongchi T Nguyen
(74) *Attorney, Agent, or Firm* — Stephen L. Sheldon

(57) ABSTRACT

A low-profile connector for use with electronic devices provides a cantilevered latching arm with a pair of engagement hooks that engage mating holes in a guide frame, and which can be easily unlatched from the guide frame or opposing connector or housing. The hooks lock the plug connector into engagement with the frame or housing, but are readily released by way of a rotating cam lobe mechanism. The lobe mechanism converts horizontal pulling movement of an actuator into vertical, lifting movement of the latching arm such that the hooks are lifted upward and disengaged from the guide frame or housing.

17 Claims, 6 Drawing Sheets

LOW PROFILE LATCHING CONNECTOR

REFERENCE To RELATED APPLICATIONS

The Present Disclosure claims priority to prior-filed U.S. Provisional Patent Application No. 61/844,757, entitled "Low Profile Latching Connector," and filed with the United States Patent And Trademark Office on 10 Jul. 2013. The content of the aforementioned Application is fully incorporated herein in its entirety.

BACKGROUND OF THE PRESENT DISCLOSURE

The Present Disclosure is directed to small and low-profile connectors. More particularly, the Present Disclosure is directed to pluggable-style connectors received within a housing, or guide frame, and which require some sort of exterior latch operable to engage and disengage the connectors from their mated engagement with the housing.

Small and low-profile connectors, such as those used in SFP (Small Form Pluggable) applications are routinely used in electronic devices in which space is at a premium; typically, such connectors are used to make connections with routers and servers. The routers and servers are located in wiring closets, where space is also at a premium. Reliable engagement is desired along with a small size. The need to have a smaller size may affect the reliability of the engagement of the connector. Such a connector has a latch operated by an external operator. In order to provide good engagement, the latches of these connectors are formed with either a large depth or the actuator is provided with a large, vertical stroke for engaging and disengaging the latch. The use of large vertical operating strokes for latches defeats the purpose of reduced sizes of connectors.

A known connector is described in U.S. Pat. No. 7,281,937, issued 16 Oct. 2007 to the Assignee of the Present Disclosure, the content of which is hereby incorporated in its entirety herein; that connector has a plug body with a longitudinal channel formed in it. The channel receives an elongated actuator in the form of a pull tab and the forward end of the actuator has a pin-like, or cylindrical end portion that rides up and down a ramp. The end portion makes contact with a latching member that extends in the channel and over the actuator. Movement of the actuator moves the end portion up and down the ramp, into contact with the latching member, causing it to selectively raise or lower the latching member. Although this connector provides reliable latching, the height required for the latching member to travel in its engagement/disengagement is relatively high and as such, this connector is impractical to use in reduced size settings where more connector density is desired.

The Present Disclosure is therefore directed to a small size, and low profile pluggable connector that overcomes the aforementioned shortcomings and which has a reduced stroke height for actuating the latching member associated with the connector.

SUMMARY OF THE PRESENT DISCLOSURE

In a preferred embodiment as described in the Present Disclosure, a low-profile latching plug connector is provided comprised of an elongated connector housing formed from two interengaging halves. The connector housing may have a non-uniform configuration, that is, a front, or first, section of the plug connector housing sized and shaped to fit within a mating receptacle connector and this section includes a mating end with exposed terminals for connecting to opposing terminals in the receptacle connector. A second, or rear, section of the plug connector may have a larger cross-section than the first section such that it will not fit within the opposing housing or guide frame, and thus may be considered as a body portion of the plug connector. The rear section of the plug connector also receives and supports one or more multiple wire cables therein which are terminated to contacts disposed within the front section of the connector.

The plug connector is latched into engagement with its opposing, associated receptacle connector by a latching member, which may take the form of an elongated arm that extends longitudinally of the plug connector. The rear end of the latching member is attached to the body portion of the connector housing in a manner to retain it in place and prevent it from moving, while the front end thereof has a free end capable of vertical movement. The attachment of the latching member to the connector housing defines a cantilevered latching structure for the connector. Engagement members in the form of hooks are disposed at the latching member free end, and are biased in one direction, typically downwardly, by the structure of the latching member, at the plug connector mating end, where they are aligned with holes or slots formed in the exterior surface of the opposing guide frame or receptacle connector housing.

An actuator is provided on that a user may lift the latching member with a simple pulling action. The actuator is interposed between the latching member and an exterior surface of the plug connector housing, and it preferably lies below the latching arm and along a top surface of the plug connector housing. The actuator preferably includes a cam end with an enlarged end portion in the form of a lobe, at its forward end. The enlarged end portion is captured received in a depression that is disposed on the connector housing near the front section of the connector housing. The enlarged end portion has, in effect, a hinged structure that permits it to rotate within the depression and up against the latching member when the actuator is pulled rearwardly.

This enlarged end portion rotation brings the forward end of the enlarged end portion clockwise (in the direction of the pulling force applied to the actuator by the user), up and. into contact with the latching member to raise it sufficiently high enough to cause the hooks thereof to disengage from the opposing receptacle housing. The enlarged end portion has a leg portion that extends rearwardly underneath the actuator and this leg portion opposes a shoulder disposed along the connector housing depression. The leg portion is separated from the actuator body portion by an intervening notch or re-entrant portion of the enlarged end portion. The shoulder defines a stop surfaces against which the leg portion contacts and stops, such that further rearward movement causes the actuator to rotate and raise the front end of the latching member. As the actuator is returned in its movement, the leg portion retreats from its contact with the depression shoulder and the enlarged end portion lowers itself into the depression. As such, the latching end of the latching member then moves downwardly into engagement with openings formed in the guide frame or receptacle connector housing.

The actuator preferably includes a pull tab in the form of a finger hole or tab at its rear end for the user to grasp and pull the actuator rearwardly. The actuator and plug connector housing include cooperating structure that limits the travel of the actuator, such as a stop member disposed on an exterior surface of the connector housing. The actuator has a slot formed in its body that engages the stop member. The length of the slot determines the extent to which the actuator may be moved on the housing. The depression, in effect, captures the actuator enlarged end portion and the need to form inclined surfaces as a cam surface for the enlarged end portion to ride upon is eliminated. Therefore, the connector housing may be made with a reduced height compared to prior known connectors.

These and other objects, features and advantages of the connector as described in the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 6 is a perspective view of the actuator of the connector of FIG. 1, with an enlarged detail view of the actuator enlarged end portion.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to he limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
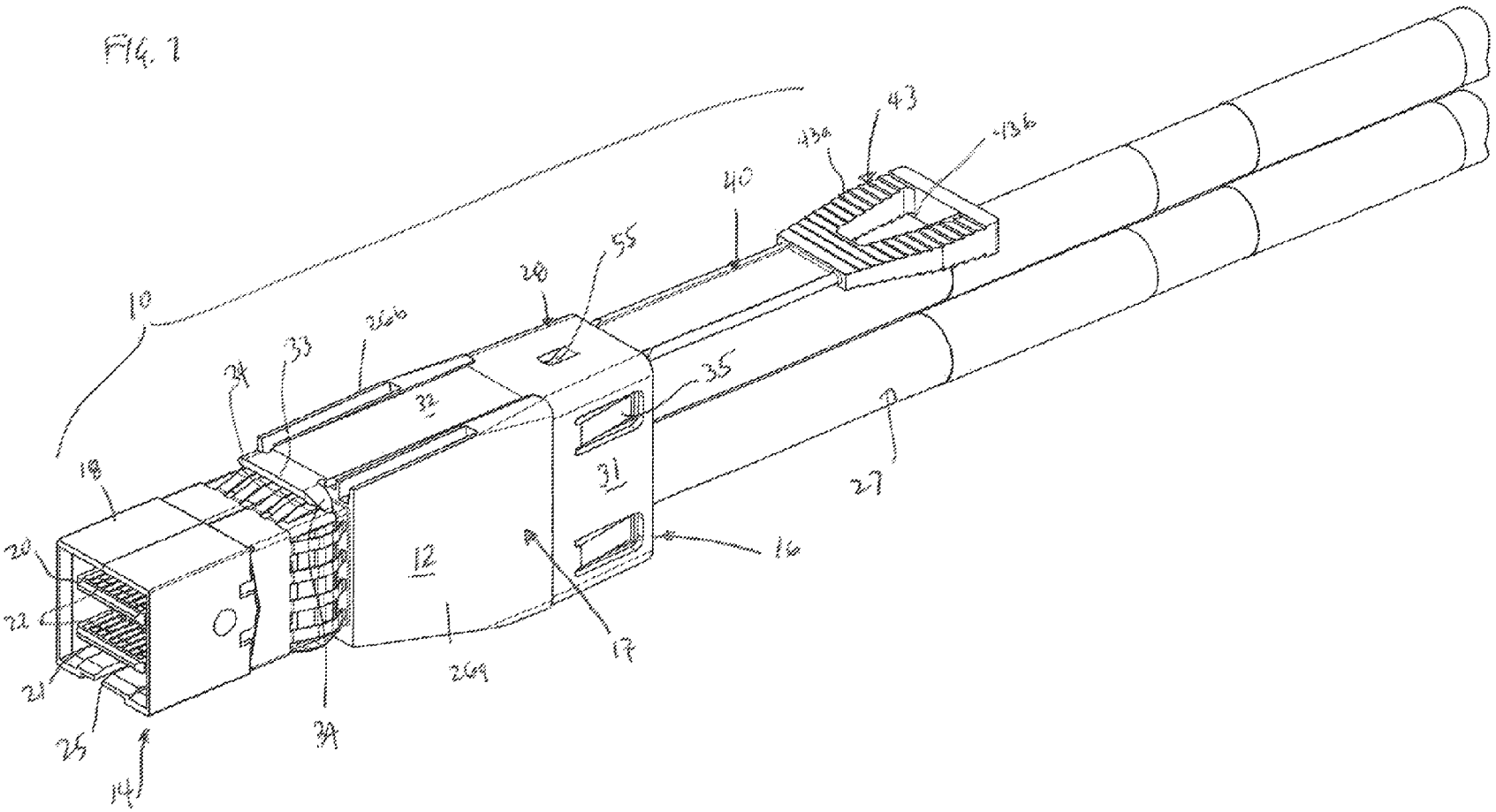
FIG. 1 is a perspective view of a low profile latching connector of the Present Disclosure.
Figure 2:
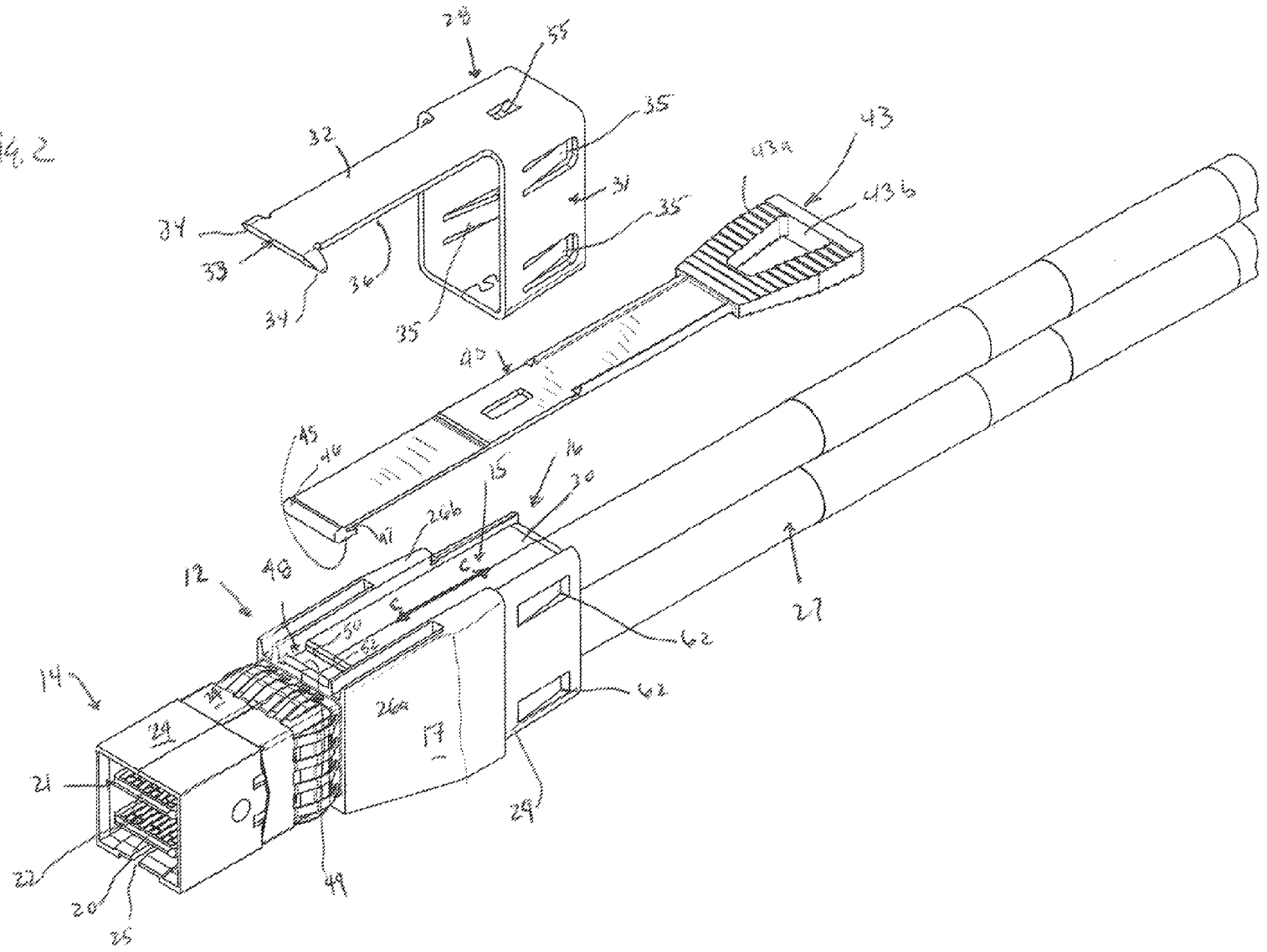
FIG. 2 is a partially exploded view of FIG. 1, with the latching member and actuator removed from their respective positions on the connector housing.
Figure 3:
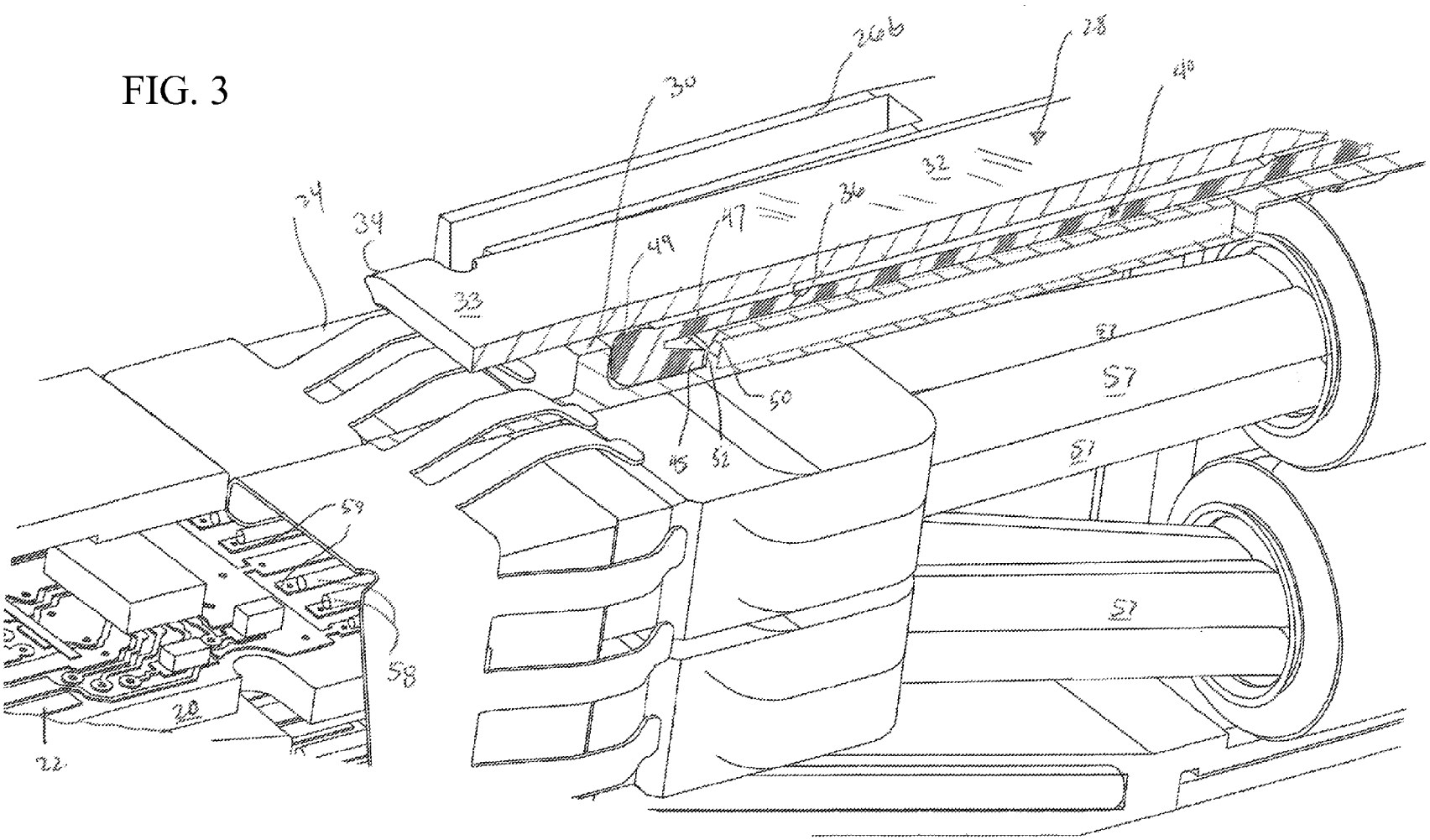
FIG. 3 is an enlarged detail view, partially in section of the connector of FIG. 1, with the left side of the connector housing removed and the latching member and actuator sectioned down the center of the connector to illustrate the location of the actuator and its free end.

FIG. 1 is a perspective view of a low-profile plug connector 10 constructed in accordance with the principles of the Present Disclosure. The plug connector 10 is seen to include an elongated connector housing 12 having two opposing ends 14, 16. The first, or front end, 14 of the plug connector body 12 defines a mating end 18 of the plug connector housing 12. This front end 14 of the connector housing 12 is shown as a rectangular cube, the cross section of which is rectangular. One or more circuit boards 20 that define mating blades 21 of the connector 10 are contained within the front end 14 of the connector housing 12. These circuit boards 20 include an arrangement of conductive contact pads 22 that make electrical contact with mating terminals in a mating receptacle connector (not shown) which is typically enclosed within an outer protective guide frame or receptacle connector housing.

The dimensions of the connector front end 14 are such that the front end fits within an opening of the guide frame that encompasses a corresponding opposing and mating receptacle connector. Inasmuch as the front end portion 14 is shown as having a cubic, or rectangular shape, it has a planar top surface 24, which is insertable into the interior portion of the guide frame 22 (not shown).

The connector housing 12 has a second (or terminating) end 16 generally opposite to its first end 14. The second, or rear end, 16 of the connector housing 12 may include a larger body portion 17 and also has a four-sided shape as illustrated. The cross-section of this body portion 17 is larger than the cross-section of the front mating end 18. The difference in size between the connector housing body portion 17 and the connector housing mating end 18 prevents the body portion 17 from being introduced during mating, into the guide frame or receptacle connector.

The front end 14 of the connector housing 12 may further include a keying or indexing feature, such as a slot 25 formed in the bottom portion thereof and configured to engage a tab on the corresponding opposing connector when the two connectors are mated. The connector housing 12 may be formed of two interengaging halves 26*a, b* with a joining line that runs along the central axis C-C of the connector housing 12. These two halves 26*a*, 26*b* may engage each other in any known suitable fashion. The rear end 16 of the connector housing 12 is configured to receive one or more multi-wire cables 27 with each cable 27 housing one or more wires 57 that have respective conductors 58 that are terminated to contacts 59 disposed on the rear of the connector circuit board(s) 20. In this manner, the wires 57 of the cables 27 may be connected to circuits on the circuit board(s) to which the opposing mating connectors are mounted.

The connector housing rear end 16 has a recess 29 disposed thereon and this recess 29, as illustrated, circumscribes almost the entirety of the connector housing rear end 16. The recess 29 provides a support base for a latching member 28 that includes, as shown, a body portion in the form of a collar 31 received by the connector housing recess 29 and an elongated latching arm 32 that extends in a cantilevered fashion from the collar 31. The collar 31 may include, as shown, a plurality of retaining members 61 in the form of tabs formed as part thereof and bent inwardly and received in corresponding slots 62 disposed on the connector housing rear end 16. These tabs serve to hold the latching member collar 31 in place on the connector housing 12 as well as seat the latching member collar in a particular disposition on the housing rear end 16. The retaining members 61 fix the latching member 28 in a desired position on the connector housing 12 so that the latching arm 32 and the latching member free end 33 are properly positioned over a selected area, especially the top surface 24 of the connector housing front end 14. In this regard, the latching member 28 is fixed so that it will not move appreciably on the connector housing 12 during use, but may be removed is desired.

The latching arm 32 terminates in a free end 33 angled slightly downwardly with respect to the latching member collar 31 portion and this latching arm 32 has one or more engagement hooks 34 formed thereon which are spaced apart widthwise of the connector 10. These engagement hooks 34 are positioned and configured to engage corresponding opposing openings in the guide frame or the receptacle connector (not shown). These engagement hooks 34 have a particular depth and in order for them to be raised an appropriate height in order to unlatch and disengage from the opposing connector, an actuator 40 is provided. As best shown in FIGS. 2 and 4-6, the actuator 40 utilizes an elongated body portion 41 having two opposing ends. One end 42 is an actuating end shown at the forward end of the actuator 40 and serves to selectively raise and lower the latching member free end 33, while the other end at the rear of the actuator 40, is a gripping end grasped and pulled by the operator to cause the actuation of the latching member free end 33 to occur. The gripping end is shown as an enlarged pull tab 43 with grooves 43*a* and a central opening 43*b* disposed therein.

In conventional connectors, the actuator was held in a slot on the housing and the slot included an inclined surface along which the actuator actuating end was moved in order to translate the longitudinal motion of the actuator into a vertical motion of the latching arm free end. The use of this inclined plane necessitated that the connector housing, especially the rear portion thereof, have a certain height, and particularly the difference in height between the connector housing front and rear portions. This resulted in relatively large size connectors. The goal in the electronics industry is to constantly reduce the size of devices and the use of an inclined ramp with its high elevation as an actuating, or cam surface, defeats that goal.

Figure 4:
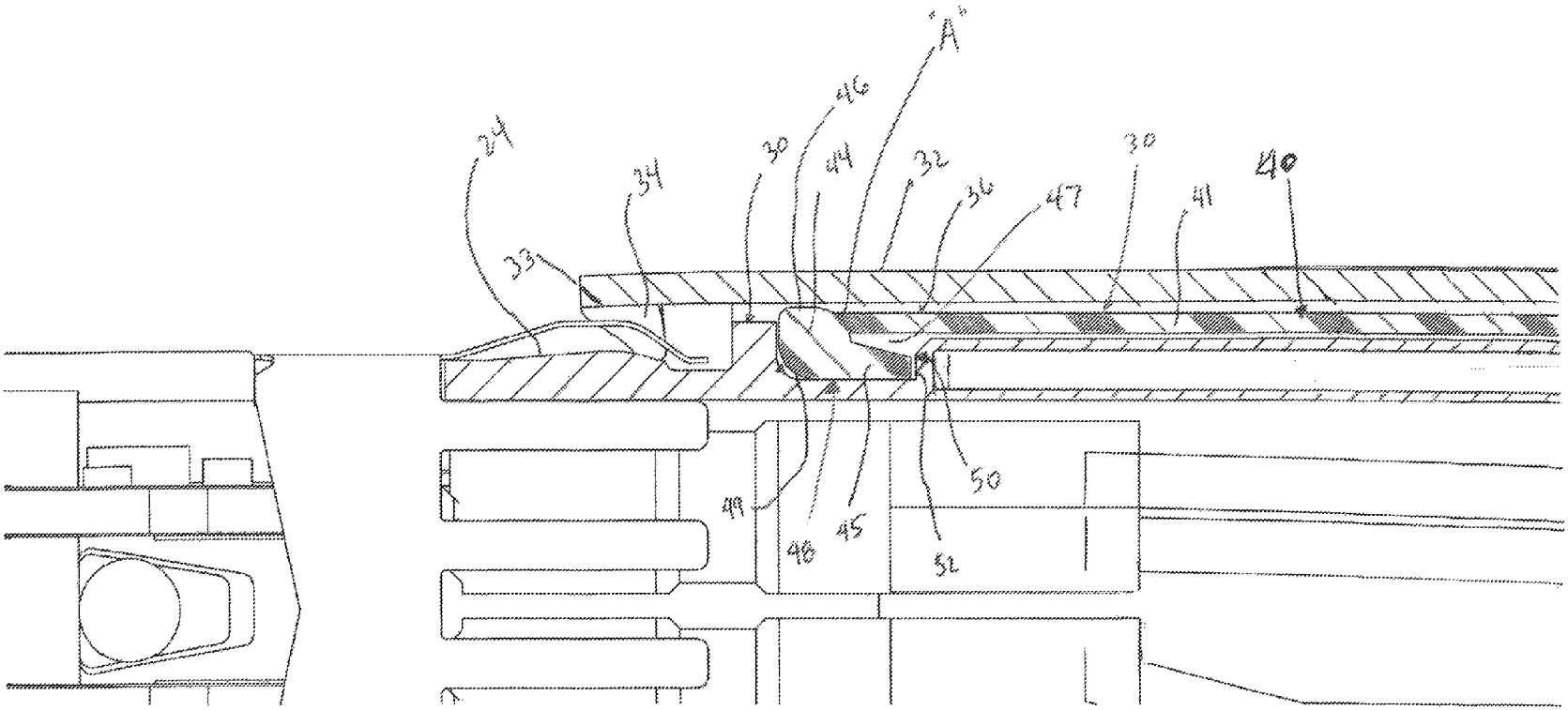
FIG. 4 is an enlarged side elevational view of the connector of FIG. 3, with the actuator free end in place in a rest position within its associated depression of the connector housing.

The connector of the Present Disclosure provides a structure that permits an overall reduction of height of the connector. It accomplishes this by providing a longitudinal channel 30 in the top surface 15 of the connector housing 12 that receives the actuator 40 therein. The channel 30 has a bottom surface that is substantially level, i.e., in a substantially horizontal plane, and does not utilize an inclined surface as a cam surface. Instead, there is a depression, or recess 48, that is disposed at the forward end of the channel 30 that in effect, captures, or traps an end of the actuator 40 therein. This recess 48 extends widthwise of the connector housing 12, or transversely to the central, longitudinal axis C-C of the channel 30. The actuator 40 is provided with a camming structure at its front end 42 in the form of an enlarged end portion 44. A separate leg portion 45 extends from this enlarged end portion 44 rearwardly under the actuator body portion 41. The actuator body portion 41 ends where the enlarged end portion 44 begins, shown at "A" in FIG. 4. The actuator leg portion 45 and the associated enlarged end portion 44 are captured in the channel recess 48 in a manner such that there is a very slight clearance between the enlarged end and leg portions 44, 45 and the surrounding connector housing 12 and this slight clearance is best shown in FIG. 4.

The channel recess 48 includes two opposing front and rear surfaces 49, 52, respectively, that extend transversely to the connector housing channel 30. The recess rear surface 52 has a shoulder portion 50 that defines a stop surface in opposition to the actuator end leg portion 45. In operation, the rear surface, or heel of the actuator leg portion 45 contacts the stop surface when the actuator pull tab 43 is grasped and pulled rearwardly. As illustrated best in FIG. 5, the actuator leg portion 45 and the enlarged end portion 44 rotate in the same direction as the pulling force, clockwise or rearwardly, in the Figure, so that the enlarged end portion 44 pivots and rises up into contact with the bottom surface 36 of the latching member 28, thereby lifting the latching member free end 33 upwardly. Because the latching member free end 33 is cantilevered and because the actuator enlarged end portion 44 is spaced close to the free end 33 of the latching member 28, this upward movement of the latching member 28 raises the engagement hooks 34 high enough to unlatch and disengage from the corresponding openings in the opposing guide frame or connector. In order to reliably disengage the engagement hooks 34 from the opposing guide frame, the length EL of the actuator enlarged end portion 44 and leg portion 45 extending therefrom should be not less than the height EH of the engagement hooks 34. In this manner, the rotation of the actuator enlarged end portion 44 reliably raises the latching member free end 33.

Figure 5:
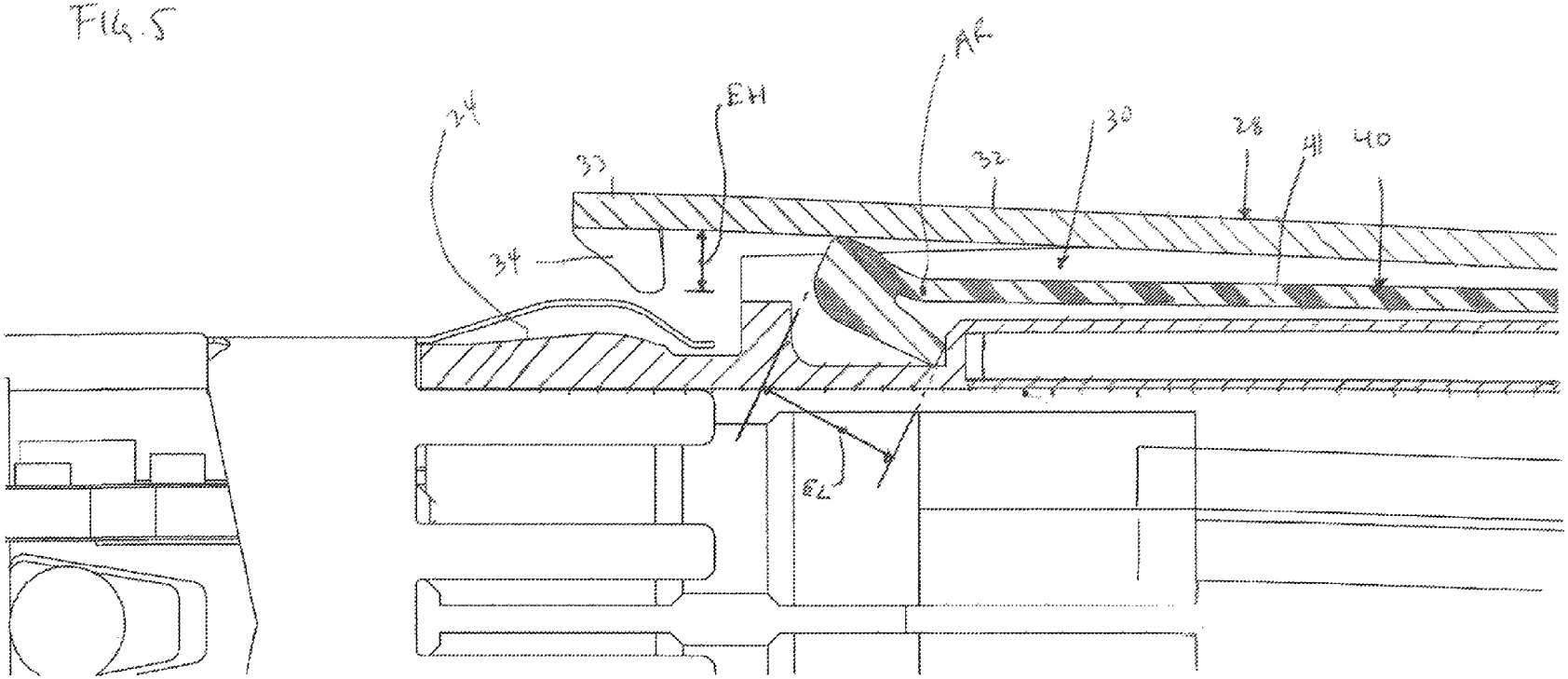
FIG. 5 is the same view as FIG. 4, but illustrating the rotational movement of the actuator free end when the actuator is pulled.
Figure 7:
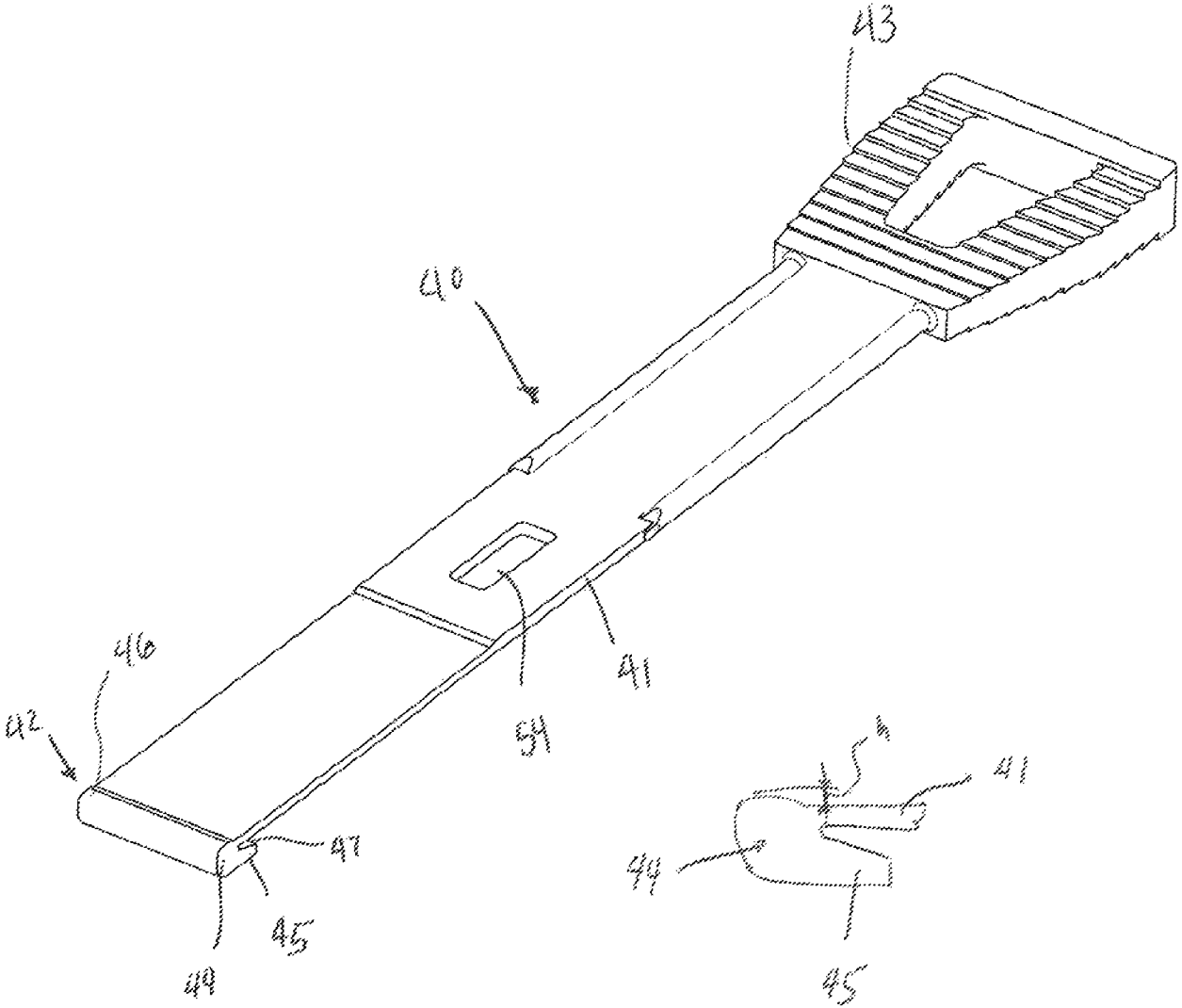

The actuator enlarged end portion 44 therefore acts a hinge with a point of rotation at approximately where the actuator body portion 41 meets the enlarged end portion 44. The enlarged end portion 44, as shown in FIG. 5, has a length from the front end of the actuator to the end of the leg portion 45. The actuator body portion 41 extends over the leg portion 45 until it ends where it joins to the enlarged end portion cam lobe. The intersection of the top and front surfaces of this cam lobe is provided with a radius R to facilitate the raising contact that occurs, and the enlarged end portion, in particular the cam lobe portion thereof is provided with a raised portion 46 that is raised to a height, h, with respect to the top surface of the actuator body portion 41 (FIG. 6.) The enlarged end portion rotates about an axis of rotation AR which is forward of the heel of the leg portion 45, as illustrated in FIG. 5.

The connector 10 may also be provided with a stop mechanism that limits the extent to which the actuator 40 may be pulled. Such a mechanism includes a slot 54 formed in the body portion 41 thereof. This slot 54 is engaged by a stop, or catch 55 formed in the latching arm 32 and bent downwardly so that it extends into the actuator slot 54 and the connector housing channel 30. The catch 55 may be a simple depression in the latching arm connected to the latching arm at both ends, or it may have a U-shaped configuration in which the open end of the U-shape faces forward and receives the rear edge of the actuator slot 54 when the actuator is drawn back so as to limit the rearward travel of the actuator. The connector 10 may also be provided with an EMI gasket in the form of a collar 70 with rearwardly extending spring contacts 72 that extend past the location of the engagement hooks 34.

Those of ordinary skill in the art will appreciate the simplicity of the connector's manner of disengagement from a mating receptacle connector simply by pulling on the easily grasped end of the actuator, which causes the engagement hooks at the free end of the latching member to be lifted out of engagement with the guide frame.

While a preferred embodiment of the Present Disclosure is shown and described, it is envisioned that those skilled in the art may devise various modifications without departing from the spirit and scope of the foregoing Description and the appended Claims.

What is claimed is:

1. A plug connector comprising:

a plug connector housing, the housing having a front portion and a rear portion, the front portion being sized to fit within a mating receptacle connector, the rear portion being configured to hold at least one cable in place within the housing, the housing including a longitudinal channel disposed thereon;

a latching member, the latching member having a first end attached to the rear portion and a second end cantilevered from the first end so that the second end extends forwardly over a portion of the front portion, the latching member including at least one engagement hook for engaging the mating receptacle connector; and an actuator for raising and lowering the second end, the actuator including an elongated body portion disposed in the channel, the body portion including a grasping end and an actuating end, the actuating end including an enlarged end portion captured within a portion of the channel, whereby exerting a pulling force on the grasping end causes the end portion to contact the channel and move upwardly, thereby raising the second end above the front portion, wherein the end portion includes a leg portion extending at least partially rearwardly under the body portion and wherein the channel includes a recess disposed therein, the recess extending transversely within the channel, the end portion being captured therewithin, the recess including a shoulder portion, the shoulder portion defining a stop surface extending transversely with respect to the actuator.

2. The plug connector of claim 1, wherein the stop surface opposes an end of end portion.

3. The plug connector of claim 1, wherein the end portion rotates toward the grasping end when a pulling force is exhibited on the actuator.

4. The plug connector of claim 1, wherein the channel has a flat bottom surface that defines a substantially horizontal plane.

5. The plug connector of claim 1, wherein the end portion rotates around a point disposed on the body portion between ends of the end portion.

6. The plug connector of claim 1, wherein the actuator further includes a re-entrant portion interposed between the body portion and the end portion.

7. The plug connector of claim 6, wherein the end and leg portions each have a length not less than a height of one of the engagement hooks.

8. A connector, comprising:

a connector body having a mating end for mating with an opposing connector and a rear end disposed opposite the mating end, the rear end defining an entry location for at least one cable, each cable containing electrical wires to enter into the connector body, the connector body including a channel disposed thereon, the channel including a transverse recess disposed therein;

a latching member having opposing first and second ends, the latching member second end engaging the body to fix the latching member thereto, the latching member including a latching arm extending away from the latching member second end in a cantilevered fashion and terminating in the latching member first end, the latching member first end defining an engagement portion that extends forwardly of the channel, the engagement portion including at least one engagement hook for engaging the opposing connector; and an actuator for moving the engagement portion between first and second operative positions, the actuator having opposing first and second ends, the actuator first end being disposed in the transverse recess and interposed between the latching member and the body, the actuator second end extending rearwardly of the mating end and including an enlarged section for grasping, the actuator first end including a cam end, whereby movement of the actuator in a first direction causes the cam end to contact the body and move upwardly into lifting contact with the latching member proximate to the engagement portion and wherein the recess includes a stop surface disposed along a rear end thereof.

9. The connector of claim 8, wherein the latching member further includes a collar that encircles the rear end.

10. The connector of claim 8, further including an electromagnetic interference gasket disposed on the body forwardly of the recess, the gasket including a plurality of spring fingers extending rearwardly past the engagement hook.

11. The connector of claim 8, wherein the cam end includes an enlarged lobe with a leg portion extending rearwardly therefrom and underneath the body portion, the leg portion being separated from the body portion by an intervening re-entrant portion.

12. The connector of claim 11, wherein the cam end rotates upwardly toward a direction of a pulling force exerted on the actuator second end.

13. The connector of claim 11, wherein the cam end rotates about an axis of rotation disposed on the body portion reawardly of the cam end.

14. The connector of claim 11, wherein the cam end enlarged lobe and leg portion have a length not less than a depth of the engagement hook.

15. A cable connector with mating with an opposing connector, comprising:

a connector housing having a mating end for mating to the opposing connector and a rear end, the rear end having an opening disposed therein for receiving at least one electrical wire therein, the rear end including a longitudinal channel disposed thereon;

a latch member disposed on the rear end, the latch member including a body portion fixed to the rear end, the body portion including an elongated latching arm that extends longitudinally along the housing, in a cantilevered fashion from the body portion toward the mating end, such that the latching arm is free to deflect in a vertical direction; and an actuator for vertically deflecting the latching arm into and out of engagement with an opposing connector, the actuator including an enlarged end and a pulling end, the enlarged end being captured in a recess disposed in the channel proximate the mating end, the enlarged end being further interposed between the latching arm and the connector housing, whereby when the actuator is pulled, the enlarged end contacts a stop surface of the recess and rotates into contact with the latching arm to vertically deflect the latching arm, wherein the end portion includes a leg portion extending at least partially rearwardly under the body portion.

16. The cable connector of claim 15, wherein the enlarged end includes a contact portion that extends above a body portion of the actuator and a leg portion extending rearwardly underneath the body portion, the enlarged end having a length less than a corresponding length of the recess.

17. The cable connector of claim 16, wherein the enlarged end contacts the stop surface when the actuator is pulled, causing the enlarged end to rotate in the direction of pulling and upwardly into contact with the latching arm.

* * * * *